US008991627B2

(12) United States Patent
Vischer

(10) Patent No.: US 8,991,627 B2
(45) Date of Patent: Mar. 31, 2015

(54) TEAT UNIT FOR FEEDING BOTTLES

(75) Inventor: Peter Vischer, Küssnacht am Rigi (CH)

(73) Assignee: Medela Holding AG, Baar (CH)

( * ) Notice: Subject to any disclaimer, the term of this patent is extended or adjusted under 35 U.S.C. 154(b) by 534 days.

(21) Appl. No.: 12/629,357

(22) Filed: Dec. 2, 2009

(65) Prior Publication Data

US 2010/0140204 A1 Jun. 10, 2010

(30) Foreign Application Priority Data

Dec. 4, 2008 (CH) ..... 1899/08

(51) Int. Cl.
*A61J 17/00* (2006.01)
*A61J 11/00* (2006.01)

(52) U.S. Cl.
CPC ..... *A61J 11/0075* (2013.01); *A61J 11/00* (2013.01); *A61J 11/0035* (2013.01); *A61J 11/006* (2013.01)
USPC ..... 215/11.1

(58) Field of Classification Search
USPC ..... 215/11.1; 606/236; 222/420, 422, 490, 222/502, 503
See application file for complete search history.

(56) References Cited

U.S. PATENT DOCUMENTS

| | | | | |
|---|---|---|---|---|
| 1,319,297 | A * | 10/1919 | Limacher | 215/11.1 |
| 1,401,958 | A * | 1/1922 | Broadwater | 215/11.1 |
| 1,683,246 | A | 9/1928 | Griffiths | |
| 2,133,411 | A * | 10/1938 | Zohe | 215/11.1 |
| 2,186,879 | A * | 1/1940 | Osterholm | 222/503 |
| 2,372,281 | A * | 3/1945 | Jordan | 215/11.5 |
| 2,495,548 | A | 1/1950 | Revane | |
| 2,584,359 | A * | 2/1952 | Miles | 215/11.4 |
| 2,665,826 | A * | 1/1954 | Mahoney | 222/422 |
| 2,901,152 | A * | 8/1959 | Wahnsiedler | 222/502 |
| 3,220,588 | A | 11/1965 | Lipari | |
| 3,661,288 | A * | 5/1972 | Noll | 215/11.1 |
| 3,924,620 | A | 12/1975 | Seunevel | |
| 4,204,328 | A * | 5/1980 | Kutner | 433/29 |
| 5,478,325 | A * | 12/1995 | Fu-Hsiang | 604/212 |
| 5,578,004 | A * | 11/1996 | Liang | 604/77 |
| 6,126,679 | A * | 10/2000 | Botts | 606/236 |
| 6,176,380 | B1 * | 1/2001 | Glories et al. | 215/11.1 |
| 6,286,697 | B1 | 9/2001 | Gasparini | |
| 2004/0035815 | A1 * | 2/2004 | Webb et al. | 215/11.4 |

FOREIGN PATENT DOCUMENTS

| | | | |
|---|---|---|---|
| CN | 101292940 | A | 5/2008 |
| DE | 2355545 | A1 | 5/1975 |
| EP | 0587505 | B1 | 5/1996 |
| EP | 0737469 | | 10/1996 |

(Continued)

OTHER PUBLICATIONS

International Search Report for PCT/CH2009/000386 mailed Mar. 17, 2010.

*Primary Examiner* — Tri Mai
(74) *Attorney, Agent, or Firm* — McDonnell Boehnen Hulbert & Berghoff LLP

(57) ABSTRACT

A teat unit for a feeding bottle has a teat and an adjustment mechanism. The teat can be changed, in terms of its shape or stiffness, by the adjustment mechanism. In this way, one and the same teat can be used with different outward forms. The teat can be adapted to the needs of the baby before or during feeding.

13 Claims, 9 Drawing Sheets

(56) References Cited

FOREIGN PATENT DOCUMENTS

| | | | |
|---|---|---|---|
| FR | 1235127 | | 7/1960 |
| FR | 1 525 195 | | 4/1967 |
| FR | 2695555 | A1 | 3/1994 |
| JP | 35-6168 | | 4/1935 |
| JP | 37-7540 | | 4/1937 |
| JP | 03-012163 | | 1/1991 |
| WO | 2004/043325 | A2 | 5/2004 |

* cited by examiner

TEAT UNIT FOR FEEDING BOTTLES

This application claims priority under 35 USC 119(e) to Swiss Application No. 01899/08, filed on Dec. 4, 2008.

BACKGROUND OF THE INVENTION

A. Technical Field of the Invention

The invention relates to a teat unit or nipple for feeding bottles, and more particularly to a teat which is manually adjustable to change its shape.

B. Description of Related Art

A baby ideally drinks from its mother's breast. However, there are various reasons why this is not always possible. For many years now, attempts have therefore been made to develop teats for feeding bottles that allow the baby to feed as naturally as possible. Mothers' breasts, however, do not have a uniform shape, nor are all babies willing to accept and drink from the same shape of teat. It is for this reason that the prior art comprises a large number of differently shaped teats, some of them of relatively complicated design.

U.S. Pat. No. 1,683,246, for example, discloses a teat with reinforcing ribs on its inner face in order to avoid closure of the suction opening during drinking. The lower area of the main body is stretched radially in order to push the teat over a bottle opening.

U.S. Pat. No. 5,673,806 discloses a teat with a mouthpiece in which a helical spring is arranged. This helical spring permits an axial stretching of the mouthpiece during feeding and increases the stiffness of the mouthpiece, such that the latter can be pressed together only slightly in the radial direction. This teat is intended to allow the baby to drink from the feeding bottle in a manner that imitates feeding at the mother's breast.

U.S. Pat. No. 6,161,710 discloses a training teat intended to teach the baby how to feed correctly at the mother's breast. The teat is composed of two membranes arranged one over the other, and the baby has to pull the outer membrane lengthwise in order to allow sufficient liquid to flow through the teat opening.

WO 2006/040542 also describes a teat with outer and inner flexible walls that are pulled lengthwise during feeding. Here too, the aim is to imitate the natural feeding action at the mother's breast.

WO 2007/137440 relates to a teat with a receiving head made of a dimensionally stable material and with a suction body made of a rubber-elastic material. The receiving head is provided with an admission channel, leading to the interior of the bottle, and with several channels leading from the admission channel to the outer surface of the receiving head. In an initial position, the suction body bears elastically and sealingly on the outer surface of the receiving head. During feeding, milk ducts are freed through which the milk is able to flow to the drinking opening.

The large number of different teats means that the parents of a baby who is unwilling to drink purchase various teats and try them out one after another on their baby. Not only is this expensive, it can also have the effect that, after a number of failed attempts, the baby will struggle even more against drinking from a feeding bottle.

SUMMARY OF THE INVENTION

It is therefore an object of the invention to make it possible for parents to try out differently shaped teats, preferably in a way that is as inexpensive and simple as possible.

It is a further objective of the invention to provide a bottle nipple (teat) which is readily, and preferably repeatedly, adjustable in its shape (shape being as presented to the mouth of the baby). In this way, the bottle nipple can be adjusted over time as the baby's feeding habits may change; or for use by more than one baby, each thereby getting its own preferred-shape teat.

These and other objects are achieved by a teat unit which, according to one aspect of the invention, is for a feeding bottle, with a manually actuated adjustment mechanism that changes the shape and/or stiffness of the teat. The teat can thus be adjusted to a desired outward form.

A single teat is therefore sufficient to adopt the nipple shape to which the baby or infant is accustomed, or to find another shape and stiffness accepted by the baby. This adjustment can be carried out on the teat before the bottle is offered to the baby. However, in another aspect, it can also be carried out during feeding.

Once the shape and/or stiffness has been adjusted, it is maintained until the adjustment mechanism is actuated again; or, alternatively, having changed as a result of the feeding action, it can be adapted to return thereafter to its initial position.

The change of shape and/or stiffness achieved by the adjustment mechanism is preferably reversible, such that the teat can also be adapted to the changing needs of the baby, and a teat setting that has been rejected at an earlier stage can be offered once more, perhaps to better advantage.

It has been shown that babies respond in different ways particularly to teats of different lengths. Therefore, in a preferred embodiment, the length of the teat can be changed by means of the adjustment mechanism. In particular, the teat can be lengthened (or shortened). In the process, it may be drawn together (i.e., radially contracted).

In another embodiment, the width of the teat can be changed, in which case the length remains unchanged, or the length too is changed.

The change in the shape and/or stiffness of the teat can be rotationally symmetrical, or it can be asymmetrical with respect to the longitudinal center axis.

Teats usually have at least one base or a main body, a mouthpiece, and a transition area between main body and mouthpiece. The main body is often also referred to as the teat base. In a preferred embodiment, it is at least this transition area, normally bearing on the baby's lips or surrounded by them, that can be changed in terms of its shape and/or stiffness.

In one embodiment, the length and width of the teat can be changed by means of the material of the teat being stretched. In order to change the length, but also the stiffness, in an uncomplicated way and without damaging the teat, the teat preferably has at least one area of increased extensibility. This area can be formed by a suitably arranged excess of material, for example by means of the material being arranged in an accordion shape or terraced shape. The abovementioned transition area is preferably one of these areas.

The adjustment mechanism can be designed in different ways. For example, it can exert a pulling force and/or pushing pressure on the teat. This force can act on the outer face or the inner face of the teat. Moreover, the adjustment mechanism can move during the adjustment and/or the teat is moved. That is, there is some kind of relative movement between the teat and some part of the adjustment mechanism.

In a preferred embodiment, the adjustment mechanism has an adjustment member which protrudes into the teat interior, and whose position relative to the teat can be changed by means of the adjustment mechanism. The adjustment member is preferably designed as a push or driver element arranged in an inner cavity of the teat, said push element being movable relative to the teat. The teat unit preferably has an actuating or driving element which is actuated manually and which is operatively connected to the adjustment member in order to press the latter against an inner face of the teat and thus change the shape and/or stiffness of the teat. In a preferred embodiment, the driving element is able to move the adjustment member relative to the teat both in a direction toward a suction opening (the nipple orifice) and also in a direction away from the suction opening.

In a preferred embodiment, the adjustment member is a head which protrudes into the teat, preferably into the area of increased extensibility. The position of the head relative to the teat can be changed by means of the adjustment mechanism. The head is able to move and/or the teat is moved. In a preferred embodiment, the teat is moved.

In a preferred embodiment, the head has a mushroom-like outer shape, which in one instance is formed by downwardly directed leaf-shaped lamellae. These lamellae can be rotationally symmetrical, or asymmetrical, with respect to the longitudinal central axis of the teat.

To secure the teat on the feeding bottle, the teat unit preferably comprises a one-part connector, or it could be a multi-part teat connector. This teat connector preferably includes the driving element or actuating element of the adjustment mechanism, and is used to set or adjust the teat.

In a preferred embodiment, the teat connector is composed principally of a base part and of a securing ring. The base part can be screwed onto a neck of the feeding bottle. The teat is held releasably in the securing ring, and the securing ring can be connected releasably to the base part.

The abovementioned adjustment member is preferably arranged on this base part and is passed through the securing ring. The position of the adjustment member relative to the teat can be changed as a result of a relative change of the position of the securing ring with respect to the base part. This relative change of the position of the securing ring is preferably effected exclusively by moving the securing ring so that it travels in the axial direction. However, rotational movements of the ring may also effect this travel. The securing ring preferably acts as the actuating or driving element.

The adjustability can be continuous or can take place in discrete steps, i.e., step by step or ratchet-like.

The structure can be designed relatively simply if the position of the securing ring can be changed with respect to the base part, i.e., the teat moves and not the adjustment member.

Further advantageous embodiments are set forth in the patent claims and the following detailed description of various embodiments.

BRIEF DESCRIPTION OF THE DRAWINGS

The subject matter of the invention is explained below on the basis of preferred illustrative embodiments shown in the attached drawings. Identical reference signs are used for identical parts. In the drawings.

DETAILED DESCRIPTION OF EMBODIMENTS OF THE INVENTION

A first illustrative embodiment of a teat unit according to the invention is shown in FIGS. 1 to 4.

Figure 2:
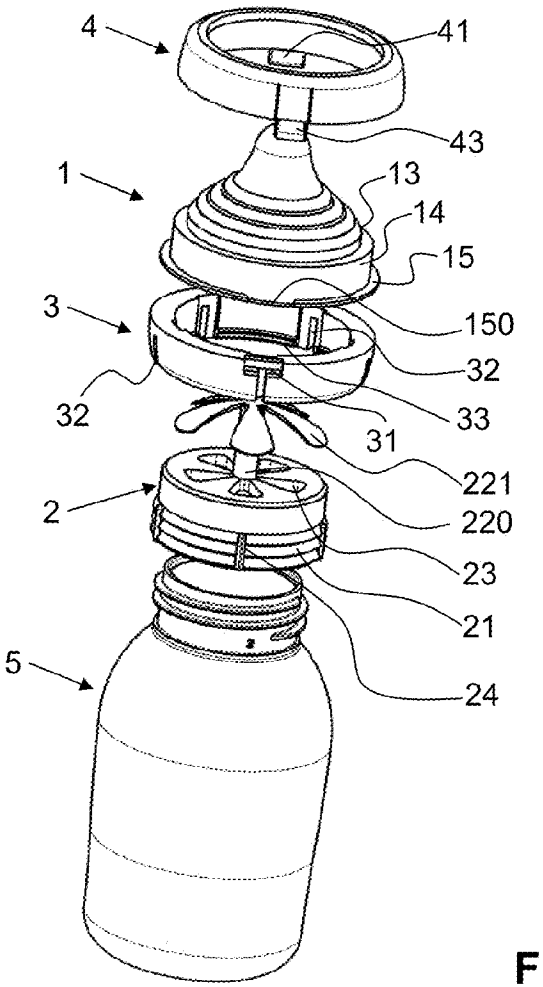
FIG. 2 shows a perspective exploded view of the feeding bottle with the teat unit shown in FIG. 1.
Figure 1:
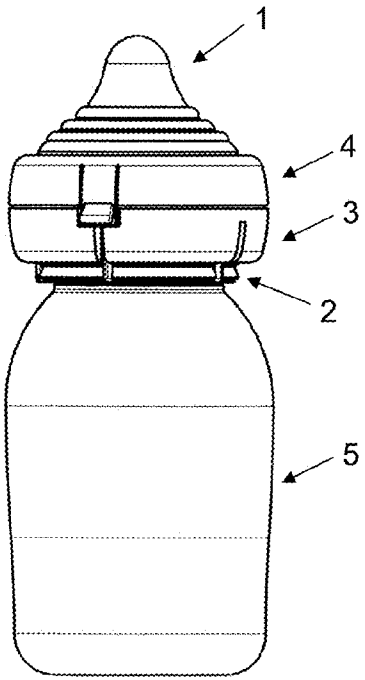
FIG. 1 shows a side view of a feeding bottle, with a teat unit according to the invention in a first embodiment.
Figure 4:
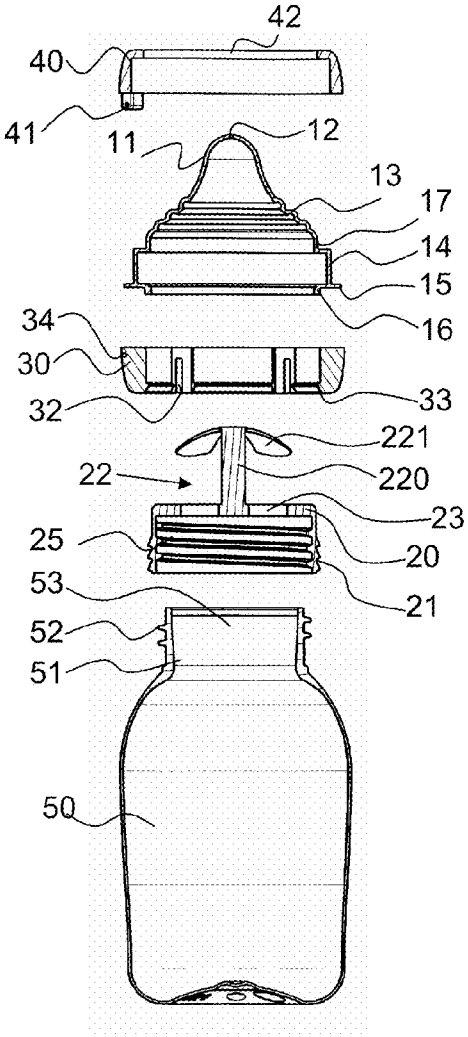
FIG. 4 shows an exploded view of the longitudinal sectional view shown in FIG. 3.
Figure 3:
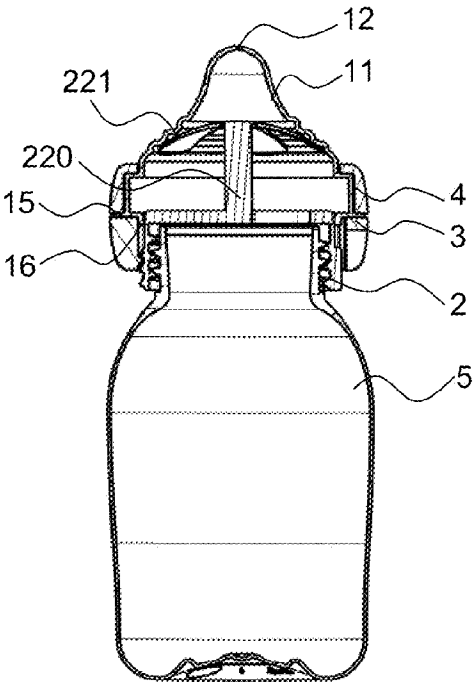
FIG. 3 shows a longitudinal sectional view through the feeding bottle and the teat unit shown in FIG. 1.

FIG. 1 shows a feeding bottle 5 of a known type. As can be seen best from FIG. 4, it has a bottle body 50 for receiving the milk or the liquid. A neck 51, formed integrally on the body 50 of the bottle, has a smaller internal and external diameter than the body 50 of the bottle. An outer thread 52 is formed integrally on the neck 51. It ends in an upper bottle opening 53 through which the milk or the liquid can pass into the teat unit arranged on the neck of the bottle.

The teat unit has a teat 1, a base part 2 and a securing ring 3, 4. The individual parts can be easily seen in FIGS. 2 and 4, while their placement on the feeding bottle can best be seen in FIG. 3. The base part 2 and the securing ring 3, 4 are preferably made of plastic and are produced in particular by injection molding.

The teat 1 is preferably made of rubber, silicone or another suitable flexible material. It is preferably designed in one piece. The teat 1 is hollow. Its wall is preferably relatively thin and corresponds to the wall thicknesses of the teats according to the prior art.

The teat is shaped rotationally symmetrically and has a main body 14, a transition area 13 formed integrally thereon, and a mouthpiece 11 narrowing toward a free end. At the free end of the mouthpiece 11 there is a suction opening 12 through which the milk or liquid can be sucked from the teat. At the other end of the main body 14 there is also an opening, the latter being connected to the suction opening such that the liquid can pass from a container 5 to the suction opening. This end of the main body 14 is also provided with an outwardly projecting peripheral flange 15, which has one or more interruptions 150. A collar 16 protrudes vertically downward from the lower, inner end of the flange 15. The main body 14 has a hollow cylindrical shape with a jacket running perpendicular to the flange 15 and parallel to a central axis. A step 17 extending horizontally thereto leads into the transition area 13. The transition area 13 is curved slightly outward in longitudinal section.

In the example shown here, the transition area 13 of the teat 1 is designed as an area of increased extensibility. For this purpose, it narrows in a terraced shape or in a bellows shape in the direction of the mouthpiece 11.

The teat 1 can have a constant wall thickness about its entire circumference. However, individual areas can also be made stiffer than others. For example, the main body 14, the flange 15 and the collar 16 can be made stiffer than the mouthpiece 11. The transition area 13 is preferably the most flexible zone of the teat 1.

The base part 2 has a substantially hollow cylindrical and relatively flat main body 20. The main body 20 is provided with an inner thread 25, such that it can be screwed onto a bottle neck 51. Retaining ribs 21 are formed integrally on its jacket. These extend, each at a constant height, about the whole circumference of the main body 20. The retaining ribs 21 are triangular in cross section, with downwardly directed points. In this example, three such ribs 21 are present. These ribs 21 are interrupted by vertically extending guide webs 24, which preferably extend over all the ribs 21. The guide webs 24 protrude outward. They are preferably arranged distributed uniformly about the outer circumference of the main body 20. In this example, five such webs 24 are present. However, another number is possible.

The upper area of the main body 20 preferably forms a plane surface. It is closed, except for a few through-openings 23 which are preferably distributed uniformly and rotationally symmetrically. In this example, the openings 23 are arranged in a rosette pattern about a central axis of the main body 20 and have a rounded triangular shape or pear shape. However, other shapes and arrangements are also possible.

An umbrella or head 22 protrudes above the upper surface of the main body 20 and is secured thereon or, as is shown here, connected integrally thereto. It is arranged centrally on the main body 20. The head 22 has a stem 220 which is directed vertically upward and on which lamellae 221 are arranged. The lamellae 221 are formed by triangular or pear-shaped leaves, which are curved slightly downward. They form a mushroom-shaped common surface. However, the latter is not completely closed, and instead it has passages resulting from the spaces between the lamellae.

The securing ring is designed in two parts. It has a lower part 3 and an upper part 4. The lower part 3 is composed principally of a hollow cylindrical main body 30. On its outer jacket, it has an indentation in which a snap-fit closure element 31, here a retaining nose, is arranged. A hinge 34 is present on the diagonally opposite side of the jacket. The main body 30 is provided with guide slits 32, which extend in the axial direction, i.e., vertically. They are open at least toward the inside of the main body 30 and downward in the direction of the bottle 5. However, they preferably extend through the full wall thickness of the main body 30, in which case they have a smaller height than the main body 30. A locking nose 33, extending at a constant height, is arranged at the lower end of the main body 30. The tip of the nose is directed upward and inward.

The upper part 4 of the securing ring also has a hollow cylindrical main body 40. On its outer jacket, it has a snap-fit closure element 43, here a resilient hook. A hinge 41 is integrally formed on the diagonally opposite end of the jacket. A through-opening is designated by reference numeral 42.

The following describes how the teat unit can be assembled and fitted on a bottle 5 or a drinking vessel. The teat 1 is placed between the lower part 3 and the upper part 4 of the securing ring. These two parts 3, 4 are connected to each other via the hinge 34, 41 and are pivotable relative to each other. As can be seen from FIG. 3, the teat 1 lies with its flange 15 on the plane upper surface of the lower part 3. The at least one interruption 150 allows air to pass into the bottle during the sucking action on the teat 1. The collar 16 protrudes downward on the inner face of the lower part 3. The upper part 4 is engaged over the cylindrical or frustoconical main body 14 of the teat 1 and surrounds this. The upper part 4 protrudes, preferably about the entire circumference, above the upper end of the main body 14 of the teat 1 and adjoins the step 17. When the snap-fit closure between the lower part 3 and upper part 4 is closed, the flange 15 is clamped between these two parts 3, 4, and the teat 1 is held sealingly in this securing ring 3, 4.

The lower part of the securing ring 3 can now be arranged on the base part 2 or may have been arranged thereon beforehand. To do so, it is pushed over the main body 20 of the base part 2, and the guide webs 21 of the base part engage in the guide slits 32 of the lower part 3. With its peripheral locking nose 33, the securing ring 3 engages behind one of the retaining ribs 21. If the guide slits 32 extend all the way to the outer jacket of the lower part 3, they at the same time serve as spring elements, which facilitate a movement of the lower part 3 relative to the base part 2. The lower part 3 can be snapped alternately onto one of the retaining ribs 21 and its position thus changed or adjusted.

The teat unit assembled in this way can now be fitted onto the bottle 5. To do so, the base part 2 is screwed onto the bottle neck 51. The base part 2 can also be secured on the bottle in another known manner. Moreover, it is possible for the base part 2 to be screwed on first, and the securing ring only then fitted onto it. Furthermore, the lower part 3 of the securing ring can first be arranged on the base part 2 and the teat 1 only then clamped between the two parts 3, 4. Alternatively, the teat can also be arranged in a securing ring that sealingly fixes the teat by means of a threaded connection.

According to the invention, the securing ring, more specifically its lower part 3, can now be arranged in different positions on the base part 2. The lower part 3 extends through the base part 2 to a greater or lesser extent, depending on which rib 21 the locking nose 33 engages in. The head 22 thus protrudes to a greater or lesser extent into the teat 1. That is to say, in the lowermost position of the locking nose 33, the head 22 passes through the teat 1 to the maximum extent and stretches it out most.

Since the external diameter and shape of the head 22 are adapted to the teat 1, the head 22 bears on the inner face of the teat 1. It preferably bears thereon in the transition area 13. If the lower part 3 is now moved onto a rib 21 lying further below, the teat 1 also moves downward and abuts more strongly on the head 22. The teat 1 and in particular the transition area 13 are stretched and the teat is thereby lengthened. The stiffness and flexibility of the teat 1 and in particular of the mouthpiece 11, and of the transition area 13 bearing on the lips of the baby, are barely changed in this example, since the transition area 13 takes up the change in length via its folds or its terraced shape.

The mother or father can therefore deliberately change the shape and/or stiffness of the teat 1 simply by moving the lower part 3 of the securing ring. The teat 1 does not have to be removed from the bottle 5. The adjustment can be made shortly before the bottle is offered to the baby. It is even possible to change it during feeding.

In this example, the adjustment is effected by a purely axial movement of the securing ring 3. It would also be possible to additionally carry out a rotational movement. The purely axial movement is preferred, however, since it can be carried out during feeding and no radial forces are exerted on the teat 1 by the head 22.

Figure 6:
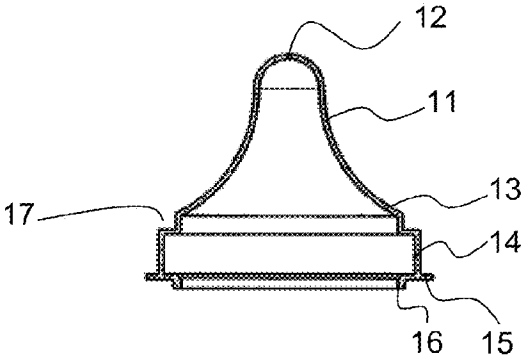
FIG. 6 shows a longitudinal sectional view through the teat shown in FIG. 5.
Figure 5:
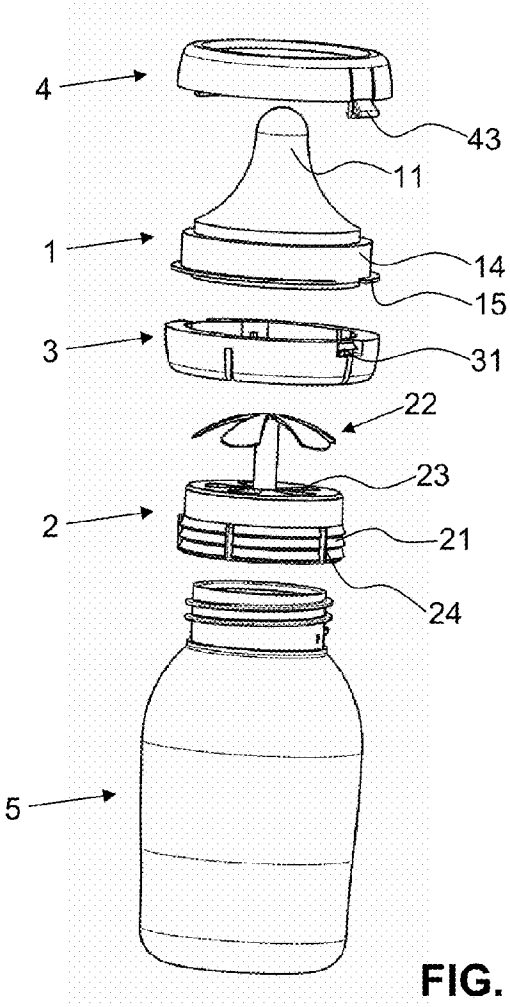
FIG. 5 shows a perspective exploded view of a feeding bottle with a teat unit according to the invention in a second embodiment.

FIGS. 5 and 6 show a second illustrative embodiment of the teat unit according to the invention. This example differs from the above one only in terms of the shape of the teat 1. The transition area 13 in this example is not terraced, with the result that the wall thickness of the teat 1 becomes thinner when the teat 1 is stretched by means of the head 22. Moreover, the transition area 13 is curved slightly inward in longitudinal section. When the head 22 acts on the inner face of this transition area 13, the inwardly curved flanks bulge outward.

Figure 9:
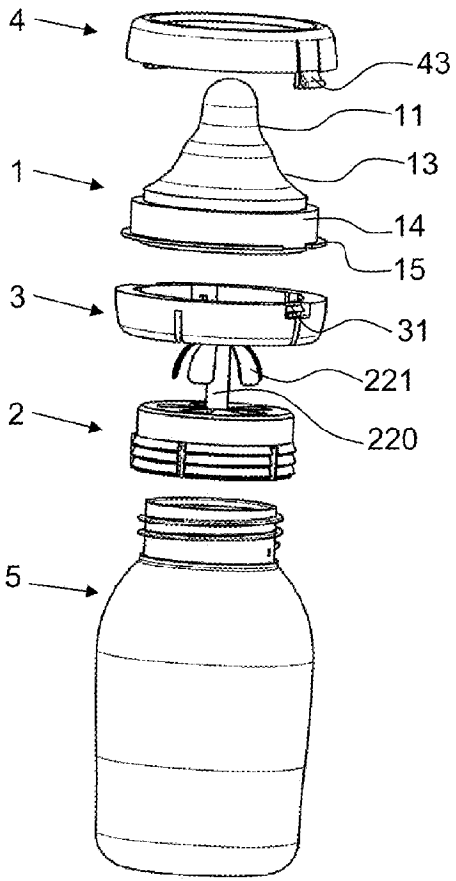
FIG. 9 shows a perspective exploded view of the feeding bottle and of the teat unit shown in FIG. 7.
Figure 8:
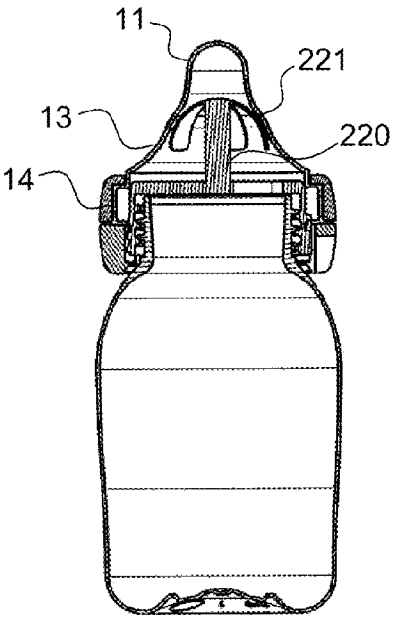
FIG. 8 shows a longitudinal sectional view through the feeding bottle and the teat unit according to FIG. 7 in the assembled state.
Figure 7:
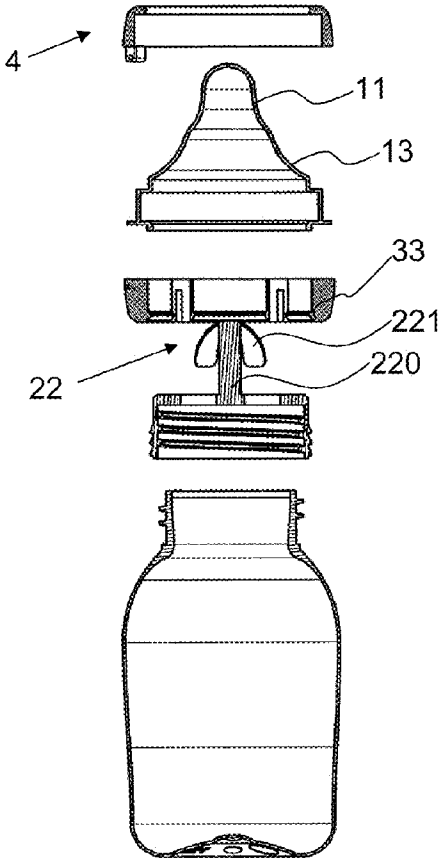
FIG. 7 shows an exploded view of a longitudinal sectional view through a feeding bottle and a teat unit according to the invention in a third embodiment.

In the illustrative embodiment according to FIGS. 7 to 9, the teat 1 and also the head 22 are modified. Once again, the teat 1 does not have a terraced or bellows-shaped transition area 13. In its upper area directed toward the mouthpiece 11, however, it has a shallower incline than the teat shown in FIGS. 5 and 6. Compared to the head described above in the first two illustrative embodiments, the head 22 is provided with lamellae 221 that are more strongly inclined downward. The diameter of the mushroom head formed by the lamellae 221 is thus smaller. This head 22 extends further into the teat 1 than the two above-described illustrative embodiments. Note how the radial shape of the teat 1 is also changed, as the head 22 moves along its axis.

This head 22 can also be used with the teat 1 of the first two illustrative embodiments or with differently shaped teats 1. Moreover, the teats 1 in the three examples can also be used with the two heads described here, or their shape and/or stability can be changed with differently shaped heads or adjustment mechanisms.

Figures 10, 11, 12:
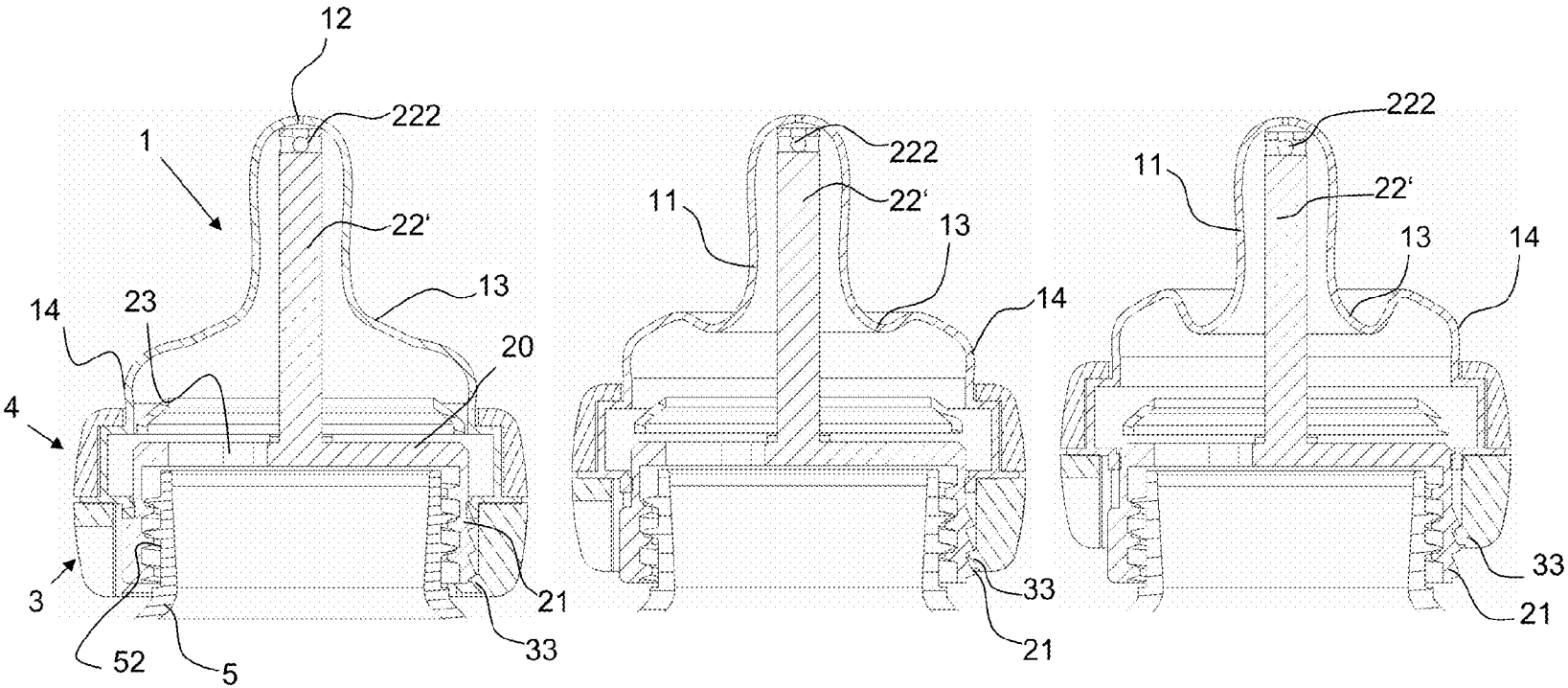
FIG. 10 shows a longitudinal sectional view through a teat unit according to the invention on a bottle according to a fourth embodiment, in a first position.
FIG. 11 shows the teat unit according to FIG. 10 in a second position.
FIG. 12 shows the teat unit according to FIG. 10 in a third position.
Figure 15:
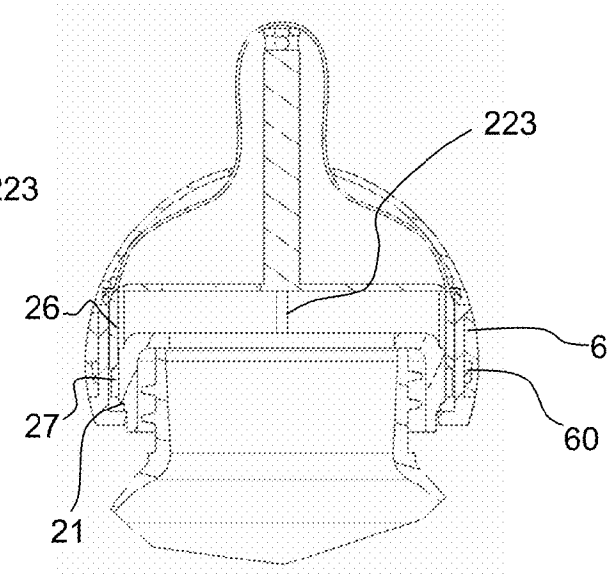
FIG. 15 shows the teat unit according to FIG. 13 in a third position.
Figure 14:
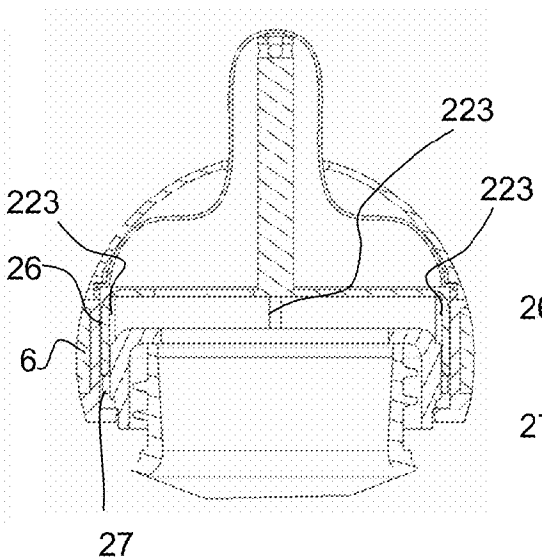
FIG. 14 shows the teat unit according to FIG. 13 in a second position.
Figure 13:
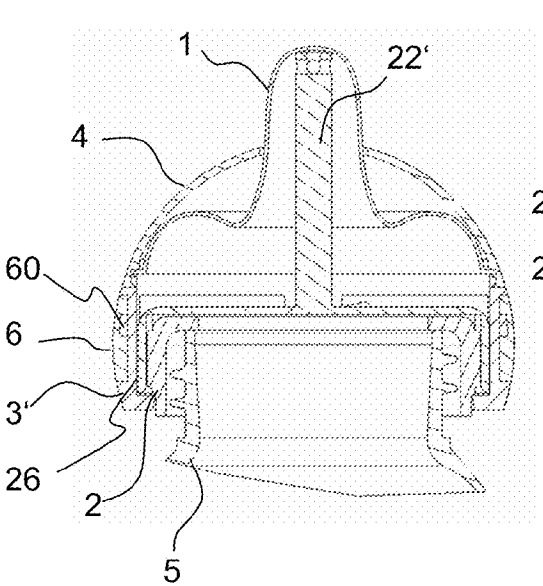
FIG. 13 shows a longitudinal sectional view through a teat unit according to the invention on a bottle according to a fifth embodiment, in a first position.
Figure 16:
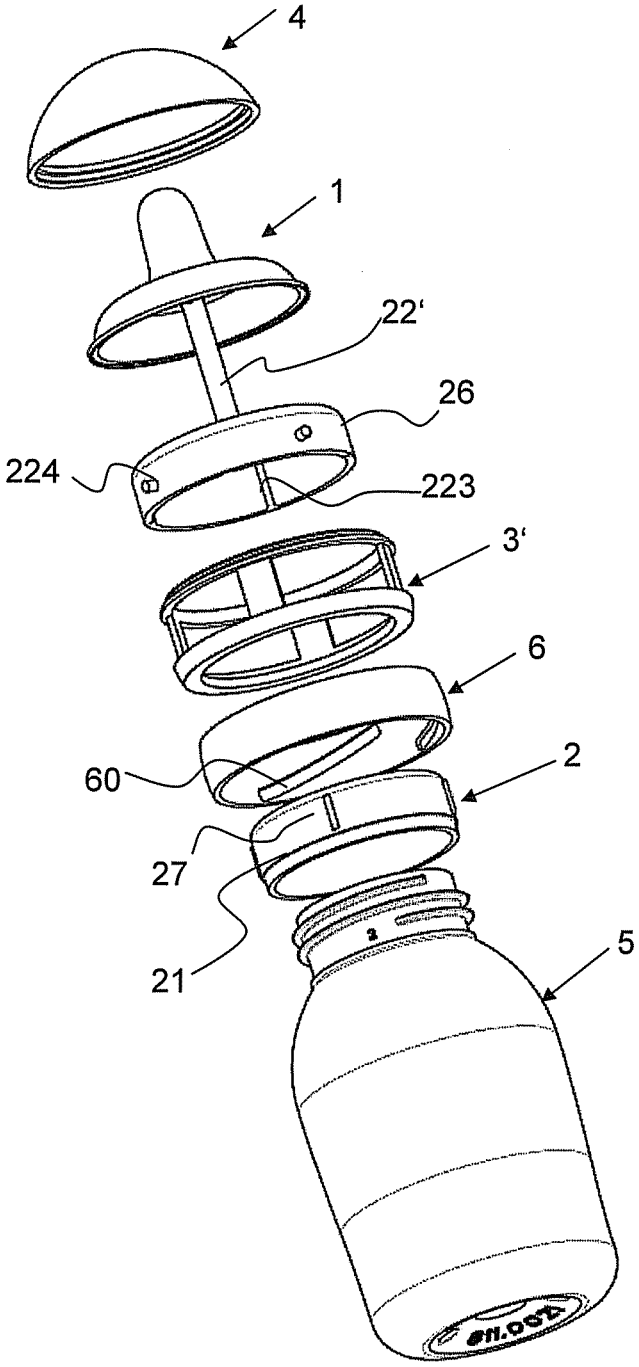
FIG. 16 shows a perspective exploded view of the teat unit with bottle shown in FIG. 13.

FIGS. 10 to 11 show an embodiment in which the freely accessible length of the mouthpiece 11 can be altered without the width of this freely accessible area being changed. The basic design of the teat unit corresponds to that of the above-described examples and is therefore not described in detail again here. Identical parts are designated by the same reference numerals. Here too, the base part 2 is screwed onto a container 5 for liquids. The base part 2 has concealed through-openings 23 through which the liquid can pass from the container 5 into the teat 1. The teat 1 is clamped sealingly between lower and upper securing rings 3, 4, and a locking nose 33 of the lower securing ring 3 engages behind one of the retaining ribs 21 of the base part 2.

In contrast to the embodiments described above, the push member is not designed now as a stiff mushroom-shaped head but as a cylindrical stiff column 22' which is arranged on the main body 20 and extends from the latter as far as the upper end of the mouthpiece 11. To ensure that it does not close the suction opening 12, it has, at its free upper end, a through-opening 222 which connects the interior of the teat 1 to the suction opening (liquid outlet or orifice) 12. In this way, the liquid can, as before, pass from the container 5 to the suction opening 12.

In FIG. 10, the locking nose 33 of the lower securing ring 3 hooks in below the lowermost retaining rib 21. The securing ring 3 is thus located in its lowermost position. The whole mouthpiece 11 is freely accessible to the baby's mouth.

In FIG. 11, the lower securing ring 3 is located in a higher position. The locking nose 33 engages behind the middle retaining rib 21. Since the uppermost part of the mouthpiece 11 bears on the column 22', the mouthpiece 11 is compressed in the transition area to the main body 14. The area of the mouthpiece 11 freely accessible to the mouth is shortened. The same applies for the overall length of the teat 1.

In FIG. 12, the lower securing ring 3 is in the uppermost position, i.e., the locking nose 33 engages behind the uppermost retaining rib 21. The transition area 13 is still further compressed, the freely accessible area of the mouthpiece 11 is further shortened, and the same applies for the entire teat 1.

As will be seen from a comparison of the three FIGS. 10 to 12, there has been no change in the width of the teat or in the width of the main body 14. The outer shape of the main body 14, which principally forms the mouth support, is approximately the same in all three positions. However, the area 13 has changed considerably in shape.

FIGS. 13 to 16 show an illustrative embodiment in which the push element 22' moves and the teat 1 remains in its position. For this purpose, the base part 2 is designed in two parts. It has an outer ring 26 on which the column 22' is arranged. The outer ring 26 encloses the main body 20 of the base part 2. The main body 20 has only one retaining rib 21, which holds the lower securing ring 3 in its position. The main body 20 of the base part 2, however, is provided with guide webs 27 that engage in guide grooves 223 of the outer ring 26.

The lower securing ring 3 has a cage 3' and an actuating ring 6. The actuating ring 6 encloses the cage 3'. On its inner circumference, the actuating ring 6 has a rising slide guide 60. Protruding knobs 224 are arranged uniformly on the outer circumference of the outer ring 26 and engage in the slide guide 60.

A rotational movement of the actuating ring 6 is transmitted via the slide guide 60 to the knobs 224 (FIG. 16) of the outer ring 26. The latter moves in the axial direction toward the main body 20 of the base part 2 on account of the guide slits 223 and guide webs 27, such that the column 22' moves upward and stretches the mouthpiece 11 of the teat 1.

In this example, the upper securing ring 4 has the shape of a spherical cap or hemisphere and extends as far as the mouthpiece 11. It serves as a mouth support, such that the baby always senses the same basic shape of the teat despite the changing length of the mouthpiece 11. In this area, the securing ring 4 is preferably flexible or soft.

FIGS. 17 to 22 show an embodiment according to the invention in which the teat is changed asymmetrically with respect to its longitudinal central axis. Here too, a rotational system is present, as has already been described above with reference to FIGS. 14 to 16.

Figures 17, 18, 19:
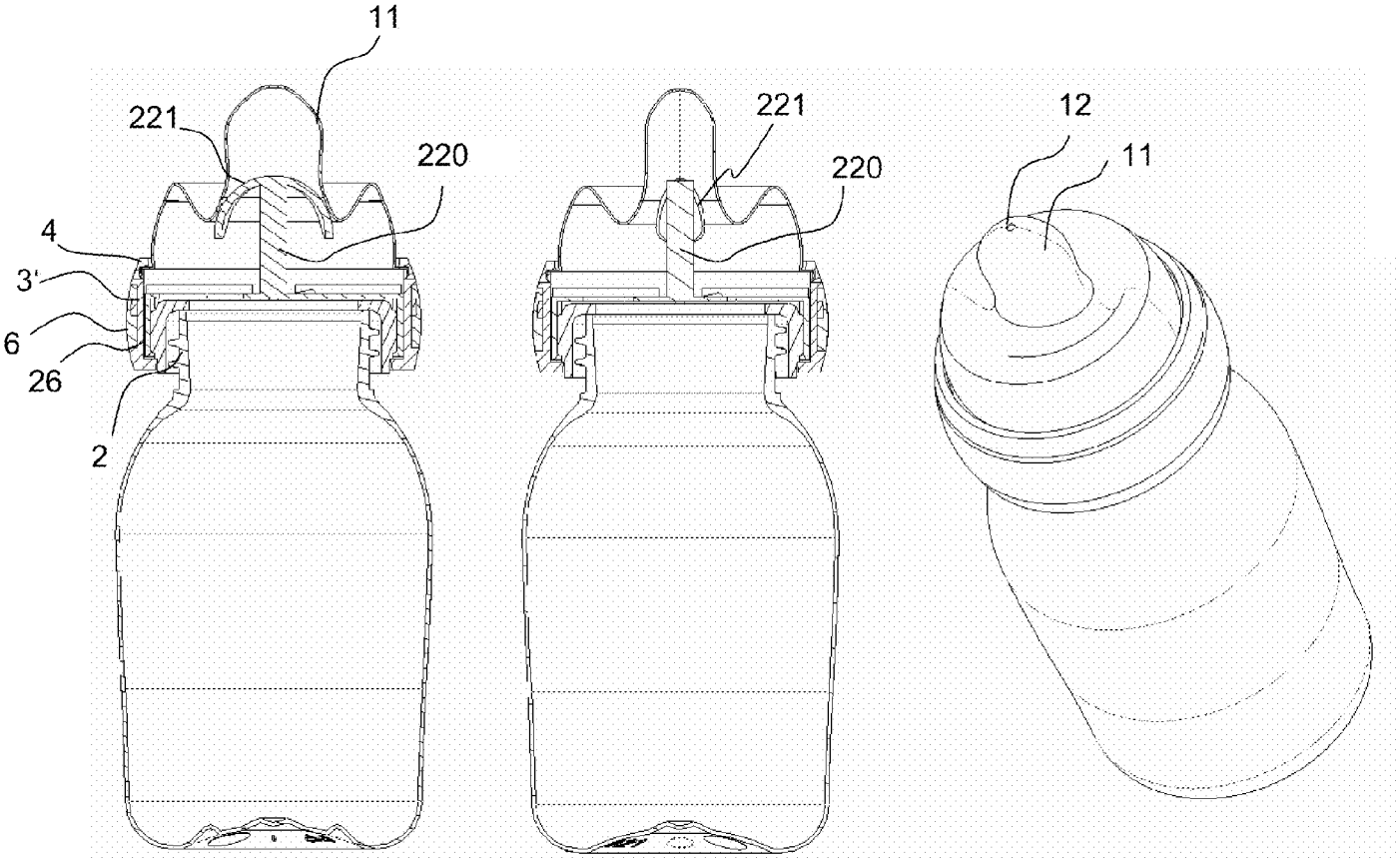
FIG. 17 shows a first longitudinal sectional view through a teat unit according to the invention, secured on a bottle, in a sixth embodiment.
FIG. 18 shows the teat unit according to FIG. 17 in a longitudinal sectional view perpendicular to the view shown in FIG. 17.
FIG. 19 shows a perspective view of the teat unit shown in FIG. 17.

FIGS. 17 and 18 show the teat in a first position, with a short teat. As will be seen, the push member again has a stem 220 and lamellae 221. Here, however, the lamellae 221 are not arranged rotationally symmetrically. This leads to a slightly flattened (in one plane) mouthpiece 11, as can be seen from FIG. 19.

Figures 20, 21, 22:
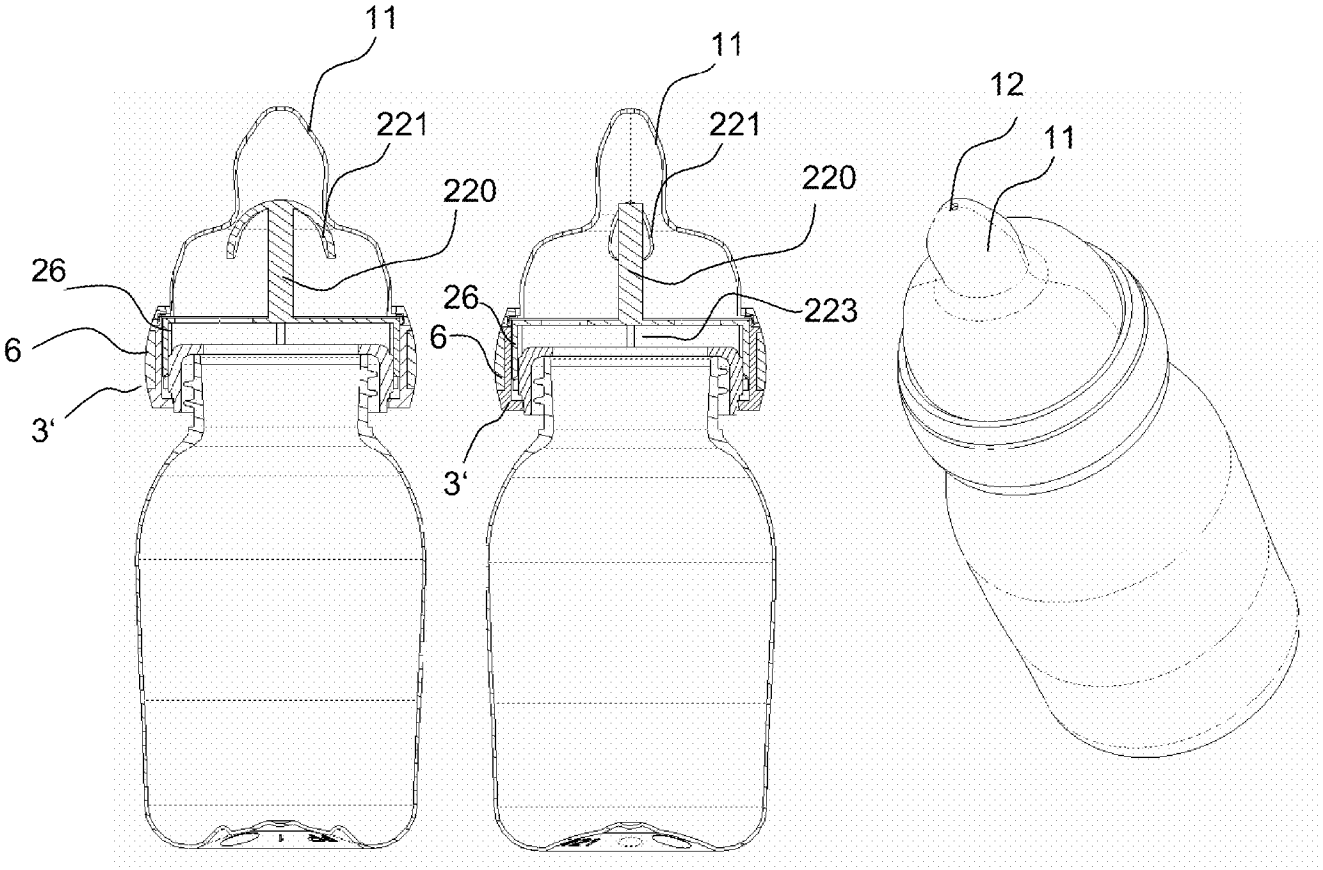
FIG. 20 shows a longitudinal sectional view through the teat unit according to FIG. 17 in a second position.
FIG. 21 shows the teat unit according to FIG. 20 in a longitudinal sectional view perpendicular to the view shown in FIG. 20.
FIG. 22 shows a perspective view of the teat unit shown in FIG. 20.

FIGS. 20 and 21 show the same teat in a second position, with a long teat. The stem 220 and the lamellae 221 are lifted by means of the rotary ring 6 and the outer ring 26. As can be seen from FIG. 22, the mouthpiece 11 is lengthened compared to FIG. 19, but still flat as before.

By virtue of the teat unit according to the invention, one and the same teat can be used in different outward forms. The teat can be adapted to the needs of the baby before or during feeding.

Thus, while the invention has been described herein with relation to certain embodiments and applications, those with skill in this art will recognize changes, modifications, alterations and the like which still come within the spirit of the inventive concept, and such are intended to be included within the scope of the invention as expressed in the following claims.

The invention claimed is:

1. An improved liquid feeding nipple unit, the liquid feeding nipple unit comprising a nipple and a mechanism comprising a mounting ring, a pusher member and nipple ring, the nipple being made of a flexible material and the nipple having a fluid delivery end with at least one opening formed therein for liquid to flow through and a widened nipple base defining a length therebetween and defining an interior space within the nipple, wherein at least a portion of the nipple is extensible, wherein the mechanism is mounted to extend the pusher member within the nipple interior, the pusher member being manually adjustable by a user to extend or contract the nipple length so as to change an exterior dimension of the nipple, thereby changing at least the nipple length, wherein the pusher member of the mechanism is located within the nipple interior, wherein the pusher member is carried on the mounting ring, the mounting ring being mountable to the mouth of a container for liquid, wherein the nipple base is mountable to the nipple ring, the nipple ring being received on the mounting ring, and wherein the nipple ring is movable by a user relative to the mounting ring so as to move the pusher member relative to the nipple interior and to stretch the nipple along the length, the nipple ring being capable of moving the pusher member relative to the nipple in a direction toward as well as away from the fluid delivery end.

2. The improved nipple of claim 1, wherein the nipple ring and the pusher ring are match-threaded, and the nipple ring is rotatable to thereby move the teat end toward or away from the pusher member through relative rotation of the rings.

3. The improved nipple of claim 2, wherein the pusher member has a generally downwardly concave shape.

4. The improved nipple of claim 3, wherein the pusher member shape is formed by a plurality of generally symmetrically arranged petals.

5. The liquid feeding nipple unit according to claim 1, wherein the change in the exterior dimension is reversible by moving the nipple ring again.

6. The liquid feeding nipple unit according to claim 1, wherein the teat has a mouthpiece comprising the fluid delivery end and a transition area between the nipple base and the mouthpiece and wherein at least this transition area can be changed in its exterior dimension by moving the pusher member.

7. The liquid feeding nipple unit according to claim 6, wherein the transition area has an area of increased extensibility compared to the nipple base and the mouthpiece.

8. The liquid feeding nipple unit according to claim 1, wherein the pusher member has a head with an outer mushroom shape and formed by downwardly directed leafshaped lamellae.

9. The liquid feeding nipple unit according to claim 1, wherein the relative movement of the nipple ring to the mounting ring is effected exclusively by moving the nipple ring in an axial direction.

10. The liquid feeding nipple unit according to claim 1, wherein the position of the nipple ring relative to the mounting ring can be changed in discrete steps.

11. The liquid feeding nipple unit according to claim 1, wherein the nipple ring comprises a lower part and an upper part and wherein the nipple comprises a flange, the flange being held between the upper part and the lower part of the nipple ring.

12. The liquid feeding nipple unit according to claim 1, wherein the nipple is moved by the relative movement of the nipple ring.

13. The liquid feeding nipple unit according to claim 1, wherein the pusher element is moved by the relative movement of the nipple ring.

* * * * *